United States Patent [19]

Uemura et al.

[11] 4,295,435

[45] Oct. 20, 1981

[54] CLOTH FEED APPARATUS

[75] Inventors: Tamio Uemura, Kawasaki; Yoshimasa Ito; Takahiro Itakura, both of Yokohama, all of Japan

[73] Assignee: Tokyo Juki Industrial Co., Ltd., Chofu, Japan

[21] Appl. No.: 71,289

[22] Filed: Aug. 30, 1979

[30] Foreign Application Priority Data

Sep. 12, 1978 [JP] Japan ..... 53-11876

[51] Int. Cl.[3] ..... D05B 27/14

[52] U.S. Cl. ..... 112/322

[58] Field of Search ..... 112/318, 319, 322; 250/233; 318/312, 313

[56] References Cited

U.S. PATENT DOCUMENTS 3,747,827 7/1973 Stanton et al. ..... 112/322 X 4,103,632 8/1978 Bowles ..... 250/233 X

FOREIGN PATENT DOCUMENTS 2736371 2/1979 Fed. Rep. of Germany ..... 112/318

2854322 6/1979 Fed. Rep. of Germany ..... 112/322

*Primary Examiner*—Peter P. Nerbun

*Attorney, Agent, or Firm*—Wegner & Bretschneider

[57] ABSTRACT

A cloth feed apparatus to be equipped with a sewing machine, the cloth feed apparatus including a roller driven by means of a stepping motor which is actuated in accordance with electric pulses generated by a detector detecting rotation of a main shaft of the sewing machine, the detector generating electric pulses by detecting slits of disc firmly mounted on a main shaft of the sewing machine.

12 Claims, 7 Drawing Figures

CLOTH FEED APPARATUS

BACKGROUND OF THE INVENTION

The present invention relates in general to a sewing machine, and particularly to a cloth feed apparatus for use in a sewing machine.

Generally, there is provided a cloth feed device for feeding a strip of cloth in synchronism with the vertical reciprocal motion of a sewing needle in a sewing machine, which cloth feed device constitutes an indispensable component either in the industrial sewing machines or in the domestic sewing machines.

While the cloth feed device as used in the domestic sewing machine may feed a cloth at a relatively slow feeding speed in accordance with a relatively slow vertical reciprocal motion of the sewing needle, it is often required for the industrial sewing machines to provide a special auxiliary cloth feed arrangement as the vertical sewing motion speed of the needle is extremely high as compared with that in the normal domestic sewing machines. In such special auxiliary cloth feed device, however, it is of such mechanical construction that the rotating motion of the main shaft for driving the sewing needle is once reduced in speed by way of reduction gears, and then converted into a swinging motion by using a crank-chain mechanism, and thus-obtained swing motion is now converted again into an intermittent rotating motion by means of a one-way clutch arrangement so as to rotate the cloth feed roller in such intermittent rotating motion. With such construction, when the up-and-down reciprocal motion of the sewing needle is made at an extremely high speed, the cloth feed roller can not follow properly such intermittent rotating motion at such extremely high speed owing to the inertia of itself and that of the one-way clutch, and then would rather move in a continuous rotating motion, and as a result, such problems have inevitably been brought in practice that the cloth might be fed untimely or improperly while the sewing needle is stitching and still remains staying in the cloth, thus causing the needle to be broken or otherwise in trouble. In addition, there have been caused such troubles that as the durability of the conventional auxiliary cloth feed device to be used at an extremely high speed depends upon the permanence of the one-way clutch at a high speed use, at such a high revolution speed as 3,500 rpm of the main needle driving shaft, the service life of the auxiliary cloth feed device would therefore turn out to be one month or shorter with such occasional troubles as spring broken or the like, that it would likely become relatively heavy in its structural weight, and that as it would inevitably bring a relatively distant gap between the sewing needle and the cloth feed roller, such device cannot serve in a curve tracing in the sewing operation.

In view of the drawbacks as experienced in the conventional auxiliary cloth feed device of mechanical construction as stated hereinbefore, the inventors of the present invention have once proposed an electronic type auxiliary cloth feed device which is adaptable in place of the conventional mechanical type cloth feed device and which can meet such problems inherent to the conventional cloth feed device. However, the electronic type auxiliary cloth feed device proposed by the inventors of the present invention is of such construction that there is produced the electric pulses in accordance with the detection signals developed from the needle position detector, and the stepping motor is driven in stepping rotating motion in accordance with the given electric pulses, when there is once brought a change in the driving speed of the sewing machine main shaft which defines the up-and-down reciprocal motion of the sewing needle, this vertical reciprocal motion of the sewing needles and the cloth feed rate as performed by the stepping motor could hardly be made in proper synchronization with each other any longer, thus disturbing the proper cloth feed so desired. In addition, the pulse generator adapted to generate such electric pulses would generally turn out to be complicated in construction and thus costly in production.

And, according to the conventional techniques, complicated electric circuits are needed for generating pulses suitable to the starting characteristics of the stepping motor. Further, such pulses that are produced in accordance with the starting characteristics have no relation with the revolution speed of the main shaft of the sewing machine so that when the revolution speed of the main shaft is changed the pulses generated in accordance with the starting characteristics become useless.

In consideration of such disadvantages particular to the first proposed arrangement as stated above, the present invention is essentially directed to the provision of an improved electronic type auxiliary cloth feed apparatus which is advantageously adaptable in coping with such drawbacks which are inevitable in the first proposed construction.

It is therefore a primary object of the present invention to provide an improved electronic type auxiliary cloth feed apparatus which can provide a desired cloth feeding effected by means of a rotary mechanism of the apparatus substantially in full synchronism with the vertical reciprocal motion of the sewing needle even in an event that there occasionally occurs a change in the revolution speed of the main driving shaft of the sewing machine, and which is relatively simple in construction.

It is another object of this invention to provide an improved electronic type auxiliary cloth feed apparatus which can effectively reduce a possibility that the sewing needle would be broken or otherwise troubled owing to an occasional asynchronization between the vertical reciprocal motion of the sewing needle and the cloth feed effected by the rotary mechanism of the apparatus.

It is a further object of this invention to provide an improved electronic type auxiliary cloth feed apparatus which can readily be adjusted with its cloth feed rate or speed and amount in accordance with a kind of cloth to be sewn, a sewing or stitching pitch of the sewing needle, or in respect of a temperature and a moisture of the ambient atmosphere, and which can also prevent a slippage puckering or a seam puckering from occurring, whereby there is assured a sewn product of desired quality.

This invention is to be described by way of preferred embodiments thereof referring to the accompanying drawings, by which these and other objects, as well as advantageous features of this invention will be made more clear, wherein.

Figure 1:
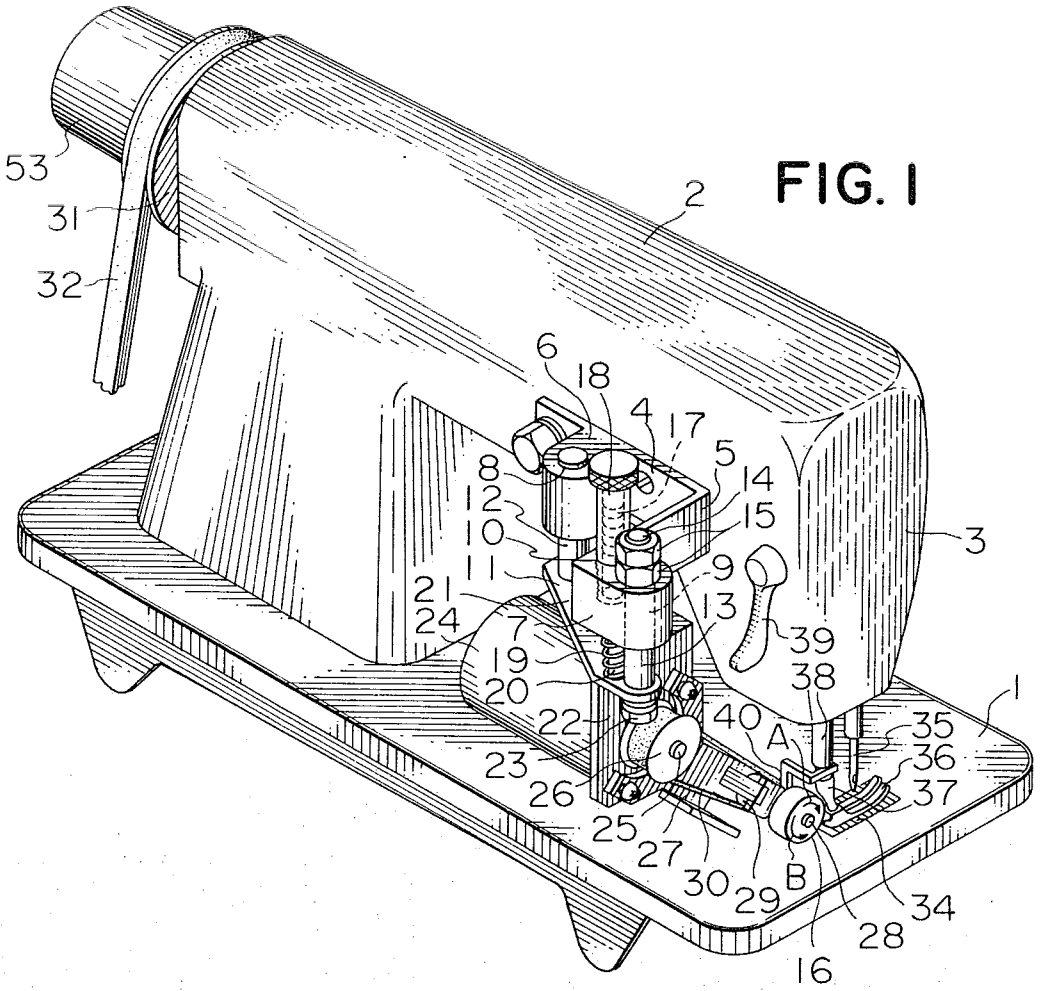
FIG. 1 is a perspective view showing a preferred embodiment of a cloth feed apparatus according to the present invention when installed to a sewing machine body.
Figure 2:
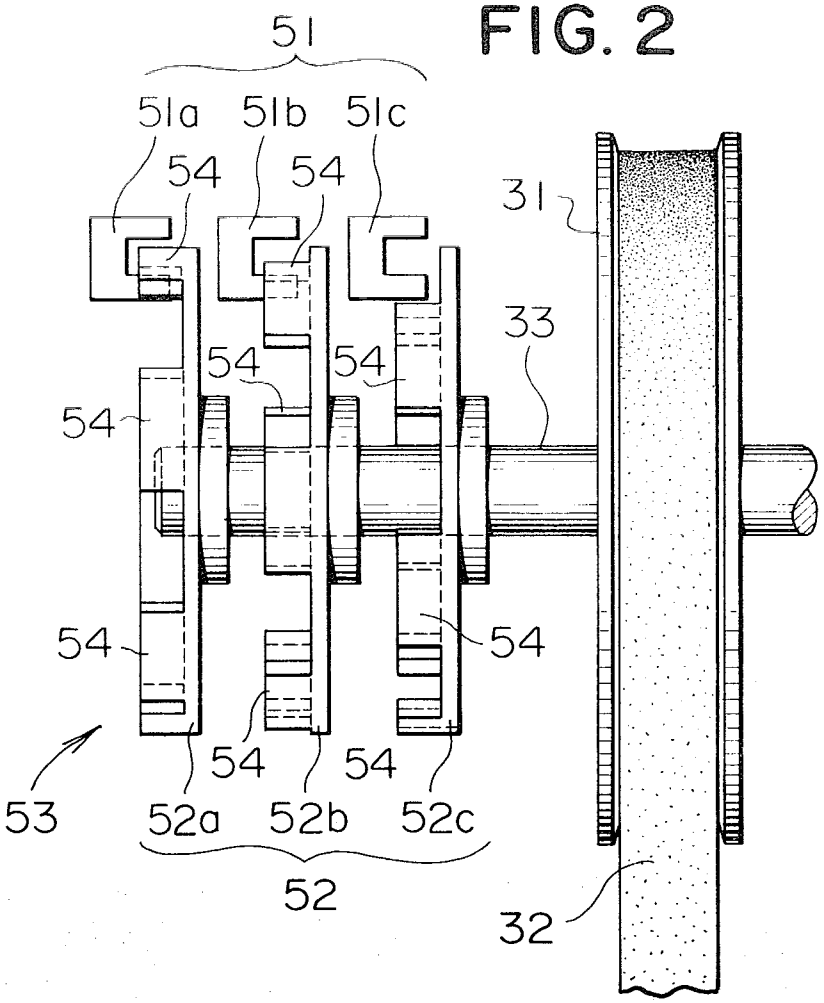
FIG. 2 is an enlarged fragmentary view in elevation showing pluralities of detectors and rotors arranged by way of a preferred embodiment of this invention.
Figure 3:
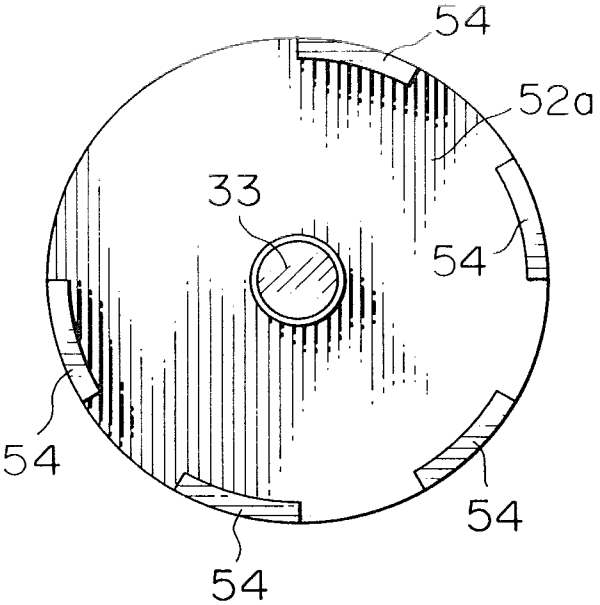
FIG. 3 is an elevational view for the illustration in more detail of one rotor shown in FIG. 2.

DETAILED DESCRIPTION OF THE PREFERRED EMBODIMENTS:

Referring to FIGS. 1 through 3, there is shown a sewing machine body 2 securely mounted upon a bed 1 having a base plate 4 of an L-shape in its plan fixed near at a head portion 3 thereof, and having a guide block 6 fixed at an opposite portion of the base plate to a projected leg 5 thereof, and also having a guide block 7 fixed at the leading end of the projected leg 5. There is provided a through opening 8 extending in the vertical direction through the guide block 6, while there are a through opening 9 and a threaded hole 10 extending likewise in the vertical direction of the other guide block 7. There is provided a bracket 11 having slide rods 12 and 13 extending upwardly therefrom, the slide rods 12 and 13 pass through the openings 8 and 9, respectively, in such a manner that they may move slidingly therethrough. The slide rod 13 has threads 14 at its upper portion, and there are nuts 15 in double connected threadedly with the threads 14 so that a vertical position of the slide rod 13, hence the entire bracket 11 secured to that slide rod 13 may be changed by manually turning the nuts 15. As these nuts 15 serve in function as a stopper and as a vertical positioning adjust means, by manually adjusting the elevation of these nuts 15 in threaded connection with the slide rod 13, it is thus possible to adjust the elevation of a roller 16 with respect to the bed 1, and consequently, it is also possible to effect such an adjustment so as to leave a small gap or blank between the lower surface of the roller 16 and the bed 1 so that there may be provided no contact therebetween as in the case that there is no cloth to be pinched therebetween.

Threaded into the threaded hole 10 is the threaded portion of a cylindrical rod 18 having a bore 17 therewithin and external threads around its outer circumference, and also having a coiled spring 19 extending within the bore 17 of the rod 18 in such a manner that the spring 19 may be adjusted with its longitudinal extend of expansion and contraction, thus adjustably urging the bracket 11 downwardly under the biasing force rendered by the lower end of the spring 19. There is inserted a guide rod 20 into the inside of the spring 19, thus preventing the spring 19 from deviating from its resting position.

The bracket 11 comprises a horizontal plate 21 and vertical plate 22 depending downwardly at right angles with the horizontal plate 21, horizontal plate 21 having through holes through which the lower ends of the slids rods 12 and 13 pass and are secured in position with nuts 23, respectively. There is securely fixed a stepping motor 24 against the vertical plate 22 with its rotating shaft 25 extending therethrough, the rotating shaft 25 being provided with a pulley 26. There is an arm 27 extending downwardly diagonally at about 45° with respect to the vertical plate 22 in such a manner that it is mounted slidably to the plate 22. There is disposed a rotatable shaft 28 at the leading end of this arm 27. Also, a pulley 29 is fixed upon at the midway of this shaft 28, and at its leading end of this shaft there is secured the roller 16. There is extended an endless belt or preferably an endless timing belt 30 between the two pulleys 26 and 29, whereby the intermittent turning force from the stepping motor 24 is operatively connected from the pulley 26 to the pulley 29 through the timing belt 30, thus causing the roller 16 to be driven in rotation.

At the opposite end of the sewing machine body 2, there is provided a driven pulley 31 which is driven by way of a driving belt 32 adapted to transmit the turning force developed by a prime mover or other drive as in the conventional sewing machine drive arrangement. When the driven pulley 31 is put in rotation, the main shaft 33 of the sewing machine securely fixed to the pulley 31 is now driven in rotation, thus developing the cloth feeding motion of a feed dog 34 and the vertical reciprocal motion of the sewing needle 35 as in the conventional cloth feed arrangement in the manner as known to those skilled in the art.

A presure foot 36 disposed above the feed dog 34 is operatively connected through a pressure foot holder 37 to a driving rod 38 extending downwardly from the head 3 of the sewing machine body 2. Also, this pressure foot 36 can manually be caused to move in the vertical direction by manually rotating a hand lifter 39 which is mounted rotatably to the machine body 2. When the pressure foot 36 is manually lowered to its normal engaging position, there is defined an engagement gap between the underside of the pressure foot 36 and the cloth feed dog 34 so that a strip of cloth to be sewn may be pinched resiliently therebetween. The arm 27 and the driving rod 38 are mutually connected by way a connection member 40 in such a manner that an upward motion of the driving rod 38 may cause the arm 27 and hence the roller 16 to be lifted upwardly. Since the driving mechanism for the cloth feed dog 34 and the sewing needle 35 is generally known in the art, further description is refrained herein.

There is provided an assembly 53 which comprises a group of detectors 51 and a group of rotors 52 cooperative with the group of detectors 51 in function to generate electric pulses at a position adjacent the driven pulley 31. In order for attaining a desired degree of resolving power in the detecting function, the group of detectors 51 and the group of rotors 52 comprise three detector components 51*a*, 51*b* and 51*c* and three component discs 52*a*, 52*b* and 52*c*, respectively. The detectors 51*a*, 51*b* and 51*c* may comprise Hall elements and field generating elements disposed in pairs opposedly to the Hall elements, respectively, which elements in pairs operate to generate or do not generate electric pulses accordingly depending upon whether or not there are presented shield plates 54 disposed securely on the discs 52*a*, 52*b* and 52*c*, respectively.

That is, the shield plate 54 works as a shield means as to shield magnetic flux produced as signals by the detectors 51*a*, 51*b* and 51*c*, while the detectors 51*a*, 51*b* and 51*c* generate electric pulses on detecting the shield of the magnetic flux at the shield plate 54.

These shield plates 54 are provided at 60° apart from each other on the disc 52*a*, for instance, around the circumferential edge thereof, thus making five plates in total, and this arrangement is true with the other discs 52*b* and 52*c* thus likewise having five plates in total, respectively. The discs 52*a*, 52*b* and 52*c* are securely mounted on the main shaft 33 of the sewing machine in such a manner as to rotate at speed in a ratio 1:1 with a revolution speed of the main shaft and to have mutual location of their shield plates 54 such that each of the shield plates 54 on the disc 52*a* is shifted or staggered in location 20° away from each of those on the disc 52*b*, and those on the disc 52*b* are shifted in location 20° away from those on the disc 52. The detector 51 may in pair comprise a light emitting diode (LED) and a photo diode disposed opposedly to the LED.

Further, the discs 52*a*, 52*b* and 52*c* may be provided at portions remoted from the main shaft 33 of the sewing machine without directly mounting on the main shaft by using gear or belt to obtain a synchronism with the main shaft 33 of the sewing machine.

Figure 4:
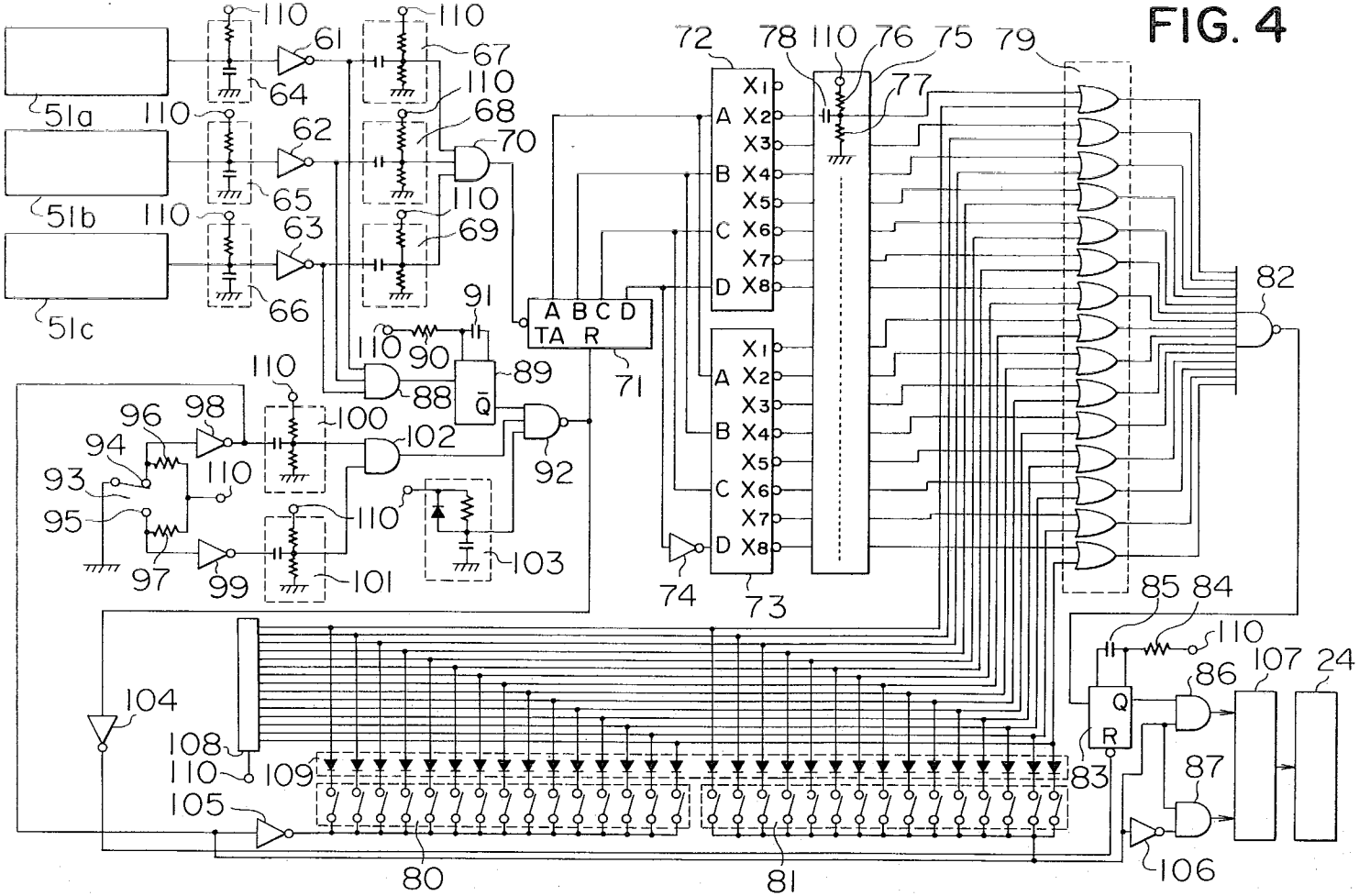
FIG. 4 is a circuit diagram showing the electric pulse processing circuit of the cloth feed apparatus according to this invention.

Now, description is given on an electric circuit for processing electric pulse trains developed from the detector 51 of such construction as stated above. Referring to FIG. 4, inverters 61, 62 and 63 have unique hysteresis characteristics in series circuit with the detectors 51*a*, 51*b* and 51*c*, respectively, so as to shape electric pulses therefrom. Noise filters 64, 65 and 66 comprise appropriately selected resistor and capacitor, respectively. The output pulses from differentiation circuits 67, 68 and 69 adapted to differentiate electric pulses from the inverters 61, 62 and 63 are supplied together to a three-input AND gate 70.

There is a hexadecimal counter 71 in circuit for counting negative pulses applied from the AND gate 70 to an input TA of the counter 71, so that its data outputs A, B, C, and D may vary at each falling point of the negative pulse as shown in the Truth Table 1 shown below. The data outputs A, B, C, and D of the hexadecimal counter 71 are fed to decoders 72 and 73, respectively. The relationship between the data inputs A, B, C, and D and the data outputs $X_1$, $X_2$ . . . $X_8$ of the decoders 72 and 73 adapted to convert from binary-coded decimal (BCD) to decimal is shown in the Truth Table 2 below.

TABLE I

| | (Counter 71) Output | | | |
|---|---|---|---|---|
| Count No. | D | C | B | A |
| 0 | 0 | 0 | 0 | 0 |
| 1 | 0 | 0 | 0 | 1 |
| 2 | 0 | 0 | 1 | 0 |
| 3 | 0 | 0 | 1 | 1 |
| 4 | 0 | 1 | 0 | 0 |
| 5 | 0 | 1 | 0 | 1 |
| 6 | 0 | 1 | 1 | 0 |
| 7 | 0 | 1 | 1 | 1 |
| 8 | 1 | 0 | 0 | 0 |
| 9 | 1 | 0 | 0 | 1 |
| 10 | 1 | 0 | 1 | 0 |
| 11 | 1 | 0 | 1 | 1 |
| 12 | 1 | 1 | 0 | 0 |
| 13 | 1 | 1 | 0 | 1 |
| 14 | 1 | 1 | 1 | 0 |
| 15 | 1 | 1 | 1 | 1 |

TABLE II

| | | | | (Decoders 72 and 73) | | | | | | | |
|---|---|---|---|---|---|---|---|---|---|---|---|
| D | C | B | A | $x_1$ | $x_2$ | $x_3$ | $x_4$ | $x_5$ | $x_6$ | $x_7$ | $x_8$ |
| 0 | 0 | 0 | 0 | 0 | 1 | 1 | 1 | 1 | 1 | 1 | 1 |
| 0 | 0 | 0 | 1 | 1 | 0 | 1 | 1 | 1 | 1 | 1 | 1 |
| 0 | 0 | 1 | 0 | 1 | 1 | 0 | 1 | 1 | 1 | 1 | 1 |
| 0 | 0 | 1 | 1 | 1 | 1 | 1 | 0 | 1 | 1 | 1 | 1 |
| 0 | 1 | 0 | 0 | 1 | 1 | 1 | 1 | 0 | 1 | 1 | 1 |
| 0 | 1 | 0 | 1 | 1 | 1 | 1 | 1 | 1 | 0 | 1 | 1 |
| 0 | 1 | 1 | 0 | 1 | 1 | 1 | 1 | 1 | 1 | 0 | 1 |
| 0 | 1 | 1 | 1 | 1 | 1 | 1 | 1 | 1 | 1 | 1 | 0 |
| 1 | 0 | 0 | 0 | 1 | 1 | 1 | 1 | 1 | 1 | 1 | 1 |
| 1 | 0 | 0 | 1 | 1 | 1 | 1 | 1 | 1 | 1 | 1 | 1 |
| 1 | 0 | 1 | 0 | 1 | 1 | 1 | 1 | 1 | 1 | 1 | 1 |
| 1 | 0 | 1 | 1 | 1 | 1 | 1 | 1 | 1 | 1 | 1 | 1 |
| 1 | 1 | 0 | 0 | 1 | 1 | 1 | 1 | 1 | 1 | 1 | 1 |
| 1 | 1 | 0 | 1 | 1 | 1 | 1 | 1 | 1 | 1 | 1 | 1 |
| 1 | 1 | 1 | 0 | 1 | 1 | 1 | 1 | 1 | 1 | 1 | 1 |
| 1 | 1 | 1 | 1 | 1 | 1 | 1 | 1 | 1 | 1 | 1 | 1 |

The output D of the hexadecimal counter 71 is inverted through an inverter 74 and fed to the input D of the decorder 73. Each component differentiation circuit of a differentiation circuit group 75 adapted to differentiate each output pulse train from the decoders 72 and 73 respectively comprised of resistors and a capacitor such that, for example, one component circuit for differentiating the output pulse train from the output $X_2$ of the decoder 72 comprises resistors 76, 77 and a capacitor 78. Note that the output $X_1$ from the decoder 72 is not used in this embodiment. To each of OR elements constituting an OR gate group 79, its one input is shown fed with each of corresponding differentiated output pulses from the decoders 72 and 73, respectively. On the other hand, to each of the other inputs of each OR element in the OR gate group 79, fed is a logic signal defined by each corresponding switch of a group of pulse select switches 80 and 81. A corresponding output from the OR gate group 79 is fed to each of inputs to a 15-input NAND gate 82. At the rising point of a positive pulse applied from the NAND gate 82, an output Q from a monostable multivibrator 83 developing a positive pulse train having a width determined by a resistor 84 and a capacitor 85 is now fed to each one input of two-input AND gates 86 and 87, respectively. The input to a three-input AND gate 88 is fed with the output from the inverters 61, 62 and 63. The output Q from a monostable multivibrator 89 generating a negative pulse having a width determined by a resistor 90 and a capacitor 91 at the rising point of the pulse train fed from the AND gate 88 is fed to the input to a three-input NAND gate 92.

In the cloth feed arrangement using the stepping motor 24 according to this invention, there is provided a switch 93 which is adapted to determine the forward cloth feed, or the feeding of a strip of cloth from the cloth feed dog 34 toward the roller 16, and the backward cloth feed, or the feeding of the cloth from the roller 16 toward the cloth feed dog 34, the switch 93 being interlocked with a forward and backward feed setting mechanism incorporated in the conventional mechanical cloth feed mechanism of the sewing machine and comprising such components as the cloth feed dog 34, and the like. Now, when a terminal 94 is connected to the ground, there is established a step for the forward cloth feed, while when a terminal 95 is selected to be grounded, there is set up a step for the backward cloth feed. The terminals 94 and 95 are connected to clamping resistors 96 and 97, respectively, the outputs from inverters 98 and 99 having unique hysteresis characteristics are differentiated by differentiation circuits 100 and 101 comprising resistors and capacitor, respectively, and then fed to a two-input AND gate 102. The output from an initialize signal generating circuit 103 comprising resistors, a capacitor and a diode and the output from the AND gate 102 are fed to the NAND gate 92. The output from the NAND gate 92 is dividedly fed to the reset terminals R's of the counter 71 and of the multivibrator 83, i.e., directly to the terminal R of the counter 71 for resetting the same, while through the inverter 104 to the terminal R of the multivibrator 83 for resetting the same, respectively. On the other hand, the output from the inverter 98 is directly fed to one terminal of each of component switches of the switch group 81 and also through the inverter 105 to one terminal of each of component switches of the switch group 80. Consequently, when the forward cloth feed is selected by means of the switch 93, the selection of electric pulses can be made by way of the switch group 80, while when the backward cloth feed is set, the selection of pulses can now be made by way of the switch group 81. On the other hand, the output from the inverter 98 is directly fed to the input of the gate 86, and also through the inverter 106 to the input of the gate 87, respectively. With such connection, there is obtained pulses for performing the forward cloth feed from the gate 86, while obtained from the gate 87 is pulses for the backward cloth feed.

There is provided a driving circuit 107 adapted to drive the stepping motor 24, and having the construction such that when the forward cloth feed is selected, the driving circuit 107 and the stepping motor 24 function to drive the roller 16 by pulses from the gate 86 in the forward rotation or in a direction as shown by an arrow A in FIG. 1, while when the backward cloth feed is selected, they work to have the roller 16 rotated by pulses from the gate 87 in the reverse direction or in the direction as shown by an arrow B. A resistor group 108 is comprised of component resistors, each of which is constructed in such a manner that it may clamp one input of each gate element of the gate group 79, which corresponds to each one selected to be turned off among the switch groups 80 and 81, to the logical ONE. A group of diodes 109 are provided which are adapted to prohibit an electric current flowing from the gate 98 to the gate 105 and vice-versa when the component switches in the switch groups 80 and 81 turn on. Each terminal 110 is fed with the DC voltage in order to maintain the state of the logical ONE.

Figure 5:
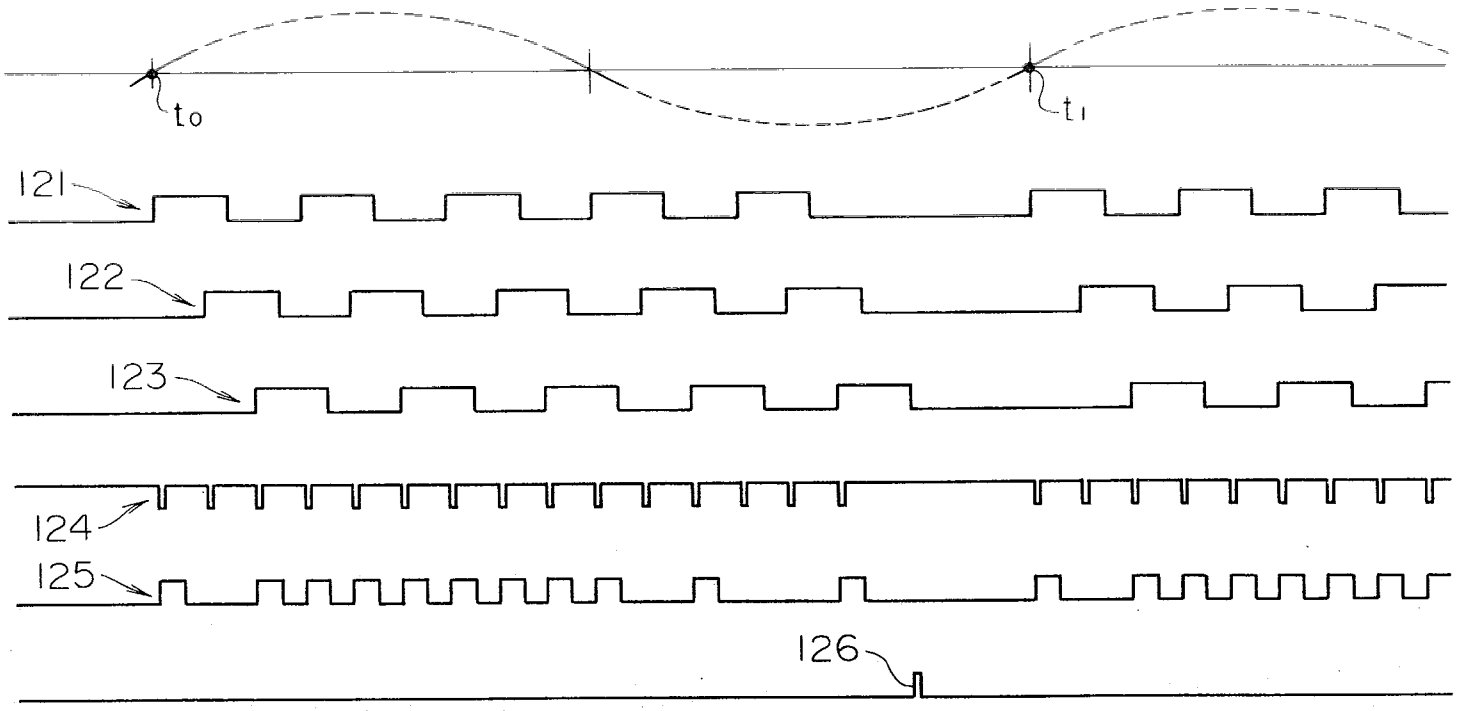
FIG. 5 is a pulse timing chart showing electric pulses produced in the electric circuit of the cloth feed apparatus shown in FIG. 4.

Next, description will now be given on the operation of the cloth feed arrangement according to this invention of such construction as stated above in reference to the pulse timing chart shown in FIG. 5. Firstly, when the forward and backward cloth feed setter in the conventional cloth feed mechanism comprising the cloth feed dog 34 and the like is set for the selection of the forward cloth feed, or the feeding of the cloth from the cloth feed dog 34 toward the roller 16, the movable contact of the switch 93 is caused to contact with the terminal 94, whereby the terminal 94 is grounded, and a signal of the logical ONE is issued from the inverter 98. When the output from the inverter 98 is set at the logical ONE, one of the terminals of each switch among the switch group 81 is set to the logical ONE, and therefore, with the component switches of the switch group 81 turned on, and any one input to each of the gate elements among the gate group 79 cannot be set to the logical ZERO. To the contrary, when the output from the inverter 98 is turned to the logical ONE, the inverter 105 now sets one terminal of each of the component switches among the switch group 80 at the logical ZERO. Consequently, with the component switches in the switch group 80 turned on, the one input to the corresponding gate element among the gate group 79 is now set at the logical ZERO. In this manner, the gate elements in the gate group 79 in which one input is set at the logical ONE function to send a negative pulse train from the differentiation circuit group 75 to the gate 82. With such connection, in order to attain a desired amount of cloth feed and a desired rate of cloth feed with one vertical reciprocal motion of the sewing needle 35 during one rotating motion of the mainshaft 33 of the sewing machine. When it is, for example, required to remove particular negative pulse trains applied from the output $X_3$ from the decoder 72 and the outputs $X_4$, $X_6$ and $X_7$ from the decoder 73, the component switches of such orders as a second, an eleventh, a thirteenth and a fourteenth are turned off, while the others are turned on among the switch group 80. With such selection of the positions of the component switches stated above, and when the pulley 31 and hence the main shaft 33 of the sewing machine is driven in rotation through the driving belt 32, the sewing needle 35 is driven in the vertical reciprocal motion and the cloth feed dog 34 in the conventional mechanical cloth feed mechanism of the sewing machine is also driven for the desired cloth feeding operation, accordingly.

In such selected sewing operation, it is arranged that corresponding to such a timing $t_o$ that the needle 35 leaves the cloth, electric pulse signals 121, 122 and 123 are issued from the detector 51a, 51b and 51c, respectively. These pulses signals 121, 122 and 123 are inverted at the inverters 61, 62 and 63, and then processed at the differentiation circuits 67, 68 and 69, respectively. Thus obtained negative pulses after the differentiation processing are supplied to the AND gate 70, thus obtaining pulse signal 124 therefrom. The hexadecimal counter 71 functions to count the pulse signal 124, thus developing a due count. Based upon thus-obtained count, the counter 71 applies the data outputs A, B, C and D as shown in the Truth Table 1 to the decoders 72 and 73, respectively. As a consequence, the output $X_2$ from the decoder 72 is now set at the logical ZERO with the appearance of the initial pulse of the negative pulse signal 124, the output $X_3$ from the decoder 72 is set at the logical ZERO with the appearance of the negative pulse in the pulse signal 124, the outputs $X_4$ through $X_8$ and the outputs $X_1$ through $X_8$ of the decoders 72 and 73 are likewise set at the logical ZERO in succession, respectively. Such signal bringing the logical ZERO is differentiated by the differentiation circuit group 75 so as to be fed as negative pulses to the input of the corresponding gate elements in the gate group 79. By the way, as the second, eleventh, thirteenth and fourteenth component switches among the switch group 80 are turned off and the remainders are on, the inputs to one side inputs of the second, eleventh, thirteenth and fourteenth gate elements from the above among the gate group 79 are set at the logical ONE, while the inputs to one side inputs to the remainders are at the logical ZERO. Consequently, the negative pulses developed from the conversion into the logical ZERO in the outputs $X_4$, $X_6$ and $X_7$ from the decoder 73 are not caused to be generated at the output from the second, eleventh, thirteenth and fourteenth gate elements from the above among the gate group 79, thus being deleted therefrom, accordingly. On the other hand, the negative pulses applied to the other gate elements in the gate group 79 are generated at the outputs of such gates, thus generated negative pulses being fed in sequence to the gate 82. This gate 82 functions to invert such negative pulses fed in sequence so as to form positive pulses, thus-generated positive pulses being fed to the multivibrator 83. This multivibrator 83 is caused to operate with the rising edge of the positive pulses, thus generating from its output Q a pulse signal 125 including positive pulses having a regular width. When this pulse signal 125 is fed to the gates 86 and 87, since there is established the step for the forward cloth feed and the output from the inverter 98 is at the logical ONE, the gate 87 operates to prohibit the pulse signal 125 from appearing at the output thereof.

On the other hand, from the output of the gate 86 there is output of pulses corresponding to the pulse signal 125, such pulses being fed to the driving circuit 107. This driving circuit 107 now functions to cause the stepping motor 24 to be driven in accordance with these pulses, whereby the stepping motor 24 drives the pulley 26, thus driving the pulley 29 through the belt 30, and hence the roller 16 in the forward direction for the forward cloth feeding operation. As it is arranged that the rotating amount and the rotating speed of the output shaft 25 of the stepping motor 24, or in other words, the amount and rate of cloth feed developed by the roller 16 are determined by means of the number of pulses and the time intervals of pulse generation to be fed to the stepping motor 24, the cloth pinched between the roller 16 and the bed 1 of the sewing machine is then fed at the desired speed and with the desired amount of cloth feeding in accordance with the pulse signal 125.

After the cloth was fed as desired, at the last falling or trailing edge of the pulse signal 123 there is output negative pulses from the multivibrator 89, this negative pulses is inverted into positive pulses 126 by the gate 92 and fed to the reset terminal R of the counter 71 so as to reset the counter 71. On the other hand, the multivibrator 83 is now reset with pulses corresponding to the negative pulses issued from the multivibrator 89, whereupon one turn or rotation of the main shaft 33 of the sewing machine, or in other words, one cloth feed cycle during one reciprocal motion or stroke of the sewing needle 35 is complete, and at this moment or the time $t_1$ when the needle 35 has just left the cloth, there is generated a pulse signal from the detectors 51a, 51b and 51c, whereby the roller 16 is again driven in rotation in the forward feeding direction, thus causing the cloth to be fed in the due forward feed motion.

On the other hand, in the backward cloth feed operation or when the cloth is fed from the roller 16 toward the cloth feed dog 34, the auxiliary cloth feed apparatus according to this invention operates in a generally similar manner as stated hereinbefore, in connection with the forward cloth feed operation.

In such backward cloth feed operation, the movable contact of the switch 93 is now connected to the terminal 95, thus having the output of the inverter 98 at the logical ZERO, thereby gate 87 generating pulses as selected by the switch group 81. With the pulses from the gate 87, the stepping motor 24 now operates to drive the roller 16 in rotation in the reverse direction, thus bringing the backward cloth feeding at the desired cloth feed speed and amount in accordance with the number and intervals of pulses in the pulses mentioned above.

Figure 6:
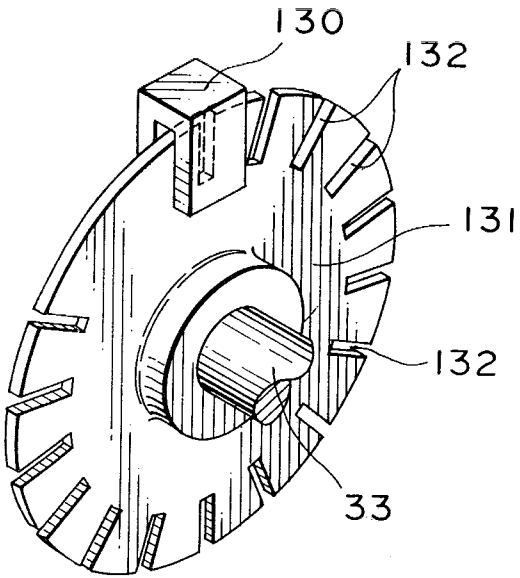
FIG. 6 is a perspective view for the illustration of the relationship between one rotor and a detector by way of another embodiment of the invention.

Incidentally, when a desired degree of resolving power is attainable with the use a single rotor, the detector and the rotor may be arranged as typically shown in FIG. 6. Now, referring to FIG. 6, the detector 130 may be of such construction comprising a Hall element, a LED, a photo transistor, or the like. There is securely mounted a single disc 131, which serves as the rotor of this invention, and which is provided with a plurality of elongated slits 132 extending in the radial direction and formed at an equal interval in such a manner that it may rotate with the main shaft 33 of the sewing machine.

In this embodiment, therefore, the shielding means are slits formed on the disc 131, and when the detector 130 comprises a LED and a photo transistor, the shielding means consisting of disc 131 with slits 132 works so as to shield the light produced as signals by the LED while the photo transistor of the detector 130 detects the light shielding at the shielding means so as to generate output electric pulses. When it is possible to provide such detecting arrangement of a relatively simple construction comprising a single detector 130 and a single disc 131, such construction naturally turns out to be simple substantially in construction, thus resulting preferably in reduction in the production cost.

When the pulse signal as obtained from this detector 130 is inverted and then supplied directly to the hexadecimal counter 71, the auxiliary cloth feed apparatus according to this embodiment is operated in the same manner as stated hereinbefore by way of the first mentioned embodiment of the invention.

Figure 7:
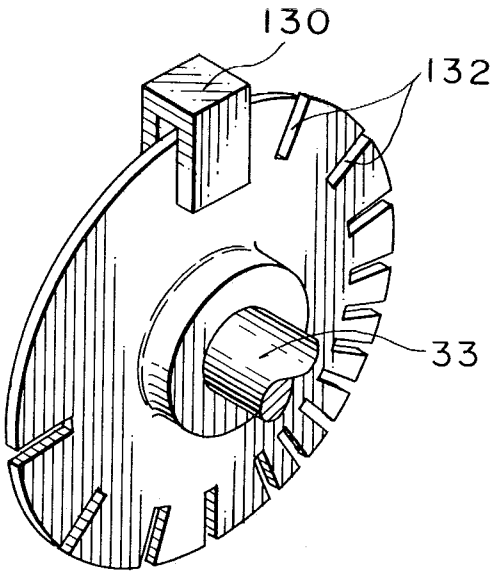
FIG. 7 is a similar perspective view to FIG. 6 showing a still another embodiment of the rotor according to this invention.

It is of course possible to provide the disc 131 having the plurality of elongated slits 132 arranged at different intervals from each other as typically shown in FIG. 7 so that a pulse signal corresponding to the pulse signal 125 can directly be obtained from the detector 130. That is, the slits 132 may be arranged at different intervals from each other in accordance with the starting characteristics of the stepping motor.

With such arrangement, the electric pulse signal from the detector 130 can, in one way, be supplied to the counter 71, but also in other way, can be supplied directly to the multivibrator 83.

Further, the disc 131 may be provided with through holes instead of slits so that the holes are detected by the detector 130, or may be provided with multiple lines of slits or through holes coaxially around the shaft 33.

While the description was restricted herein to the particular embodiments of the invention, it is apparent to those skilled in the art that there may be many other modifications or alterations of the invention without departing from the spirit and scope of the invention. For example, although the embodiment described herein is such that the cloth feed is performed in accordance with the timing that the sewing needle leaves the cloth, such arrangement is also possible in practice that such cloth feed may be made at such timing as before the needle leaves the cloth or as after the needle pierces into the cloth. Also, the detector may comprise other elements than a Hall element, such an optoelectronic element as an LED, a photo transistor, and the like. It is obvious that the auxiliary cloth feed apparatus according to this invention is applicable in practice to other cloth feed arrangement of similar construction.

What is claimed is:

1. A cloth feed apparatus for a sewing machine comprising a needle and a feed dog which is coupled to a main driving shaft, rotor means coupled to said main shaft for rotation in synchronism therewith, detector means for detecting the rotation of said rotor means to generate directly a plurality of pulses in cooperation with said rotor means, stepping motor means actuated in accordance with the pulses generated by said detecting means, and rotary mechanism means driven by said stepping motor means and feeding the cloth fed by the feed dog.

2. The cloth feed apparatus as claimed in claim 1, wherein the rotor means and the detector means generate the pulses including a first pulse train having a gradually increased width, a second pulse train of regular width preceded by the first pulse train and a third pulse train preceded by the second pulse train and having a gradually decreased width.

3. The cloth feed apparatus as claimed in claim 1, wherein the rotor means is formed with means for shielding a signal produced by the detector means and the detector means is adapted to detect the shielding of the signal by the shielding means to generate the pulses.

4. The cloth feed apparatus as claimed in claim 3, wherein said shielding means has shield plates attached to the rotor means.

5. The cloth feed apparatus as claimed in claim 4, wherein the shield plates are located at an equal interval around the circumference of the rotor means.

6. The cloth feed apparatus as claimed in claim 4, wherein the shield plates are located at different intervals around the circumference of the rotor means in accordance with the starting characteristics of the stepping motor means.

7. The cloth feed apparatus as claimed in claim 3, wherein the shielding means is formed by arranging slits in the rotor means.

8. The cloth feed apparatus as claimed in claim 7, wherein slits are provided at an equal interval around the circumference of the rotor means.

9. The cloth feed apparatus as claimed in claim 7, wherein the slits are provided at different predetermined intervals around the circumference of the rotor means in accordance with the starting characteristics of the stepping motor means.

10. The cloth feed apparatus as claimed in claim 1, 2, 3, 4 or 7, wherein the rotor means has a plurality of rotors.

11. The cloth feed apparatus as claimed in any one of claims 1, 3, 4, 7 or 9, wherein the rotor means is securely mounted on the main driving shaft.

12. The cloth feed apparatus as claimed in any one of claims 1, 2, 4, 7 or 9, which further comprises pulse selection switching means enabling any one of the pulses generated by the detector means to be deleted selectively.

* * * * *